US006435951B1

(12) United States Patent
Ishizaka

(10) Patent No.: US 6,435,951 B1
(45) Date of Patent: Aug. 20, 2002

(54) ELECTRICALLY DRIVEN GRINDER FOR CERAMIC CUTLERY

(75) Inventor: Sotomi Ishizaka, Sendai (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/606,548

(22) Filed: Jun. 29, 2000

(30) Foreign Application Priority Data

Jul. 1, 1999 (JP) ..... 11-187580

(51) Int. Cl.[7] ..... B24B 7/00

(52) U.S. Cl. ..... 451/66; 451/45; 451/111; 451/260

(58) Field of Search ..... 451/66, 45, 111, 451/260

(56) References Cited

U.S. PATENT DOCUMENTS

| | | | |
|---|---|---|---|
| 4,723,375 A | | 2/1988 | Linden |
| 4,843,769 A | * | 7/1989 | Dreiling |
| 5,906,534 A | * | 5/1999 | Folkman et al. |
| 6,012,971 A | * | 1/2000 | Friel, Sr. et al. |
| 6,113,470 A | * | 9/2000 | Marinack |

FOREIGN PATENT DOCUMENTS

| | | |
|---|---|---|
| JP | 6-61686 | 8/1994 |

* cited by examiner

*Primary Examiner*—Joseph J. Hail, III
*Assistant Examiner*—Willie Berry, Jr.
(74) *Attorney, Agent, or Firm*—Hogan & Hartson, L.L.P.

(57) ABSTRACT

An electrically driven grinder for ceramic cutlery 1 has a rough machining diamond abrasive wheel 2 comprising a disc-shaped member provided with a grinding surface on its periphery and a finishing machining diamond abrasive wheel comprising a substantially disc-shaped member provided with grinding surfaces forming a V-shaped groove on its periphery, both of which are attached onto a rotary shaft coupled to a motor, as well as has a cover member provided with guide slots for directing an edge of ceramic cutlery to the grinding surfaces of the respective diamond abrasive wheels, wherein an angle α defined between the grinding surfaces 32 forming the V-shaped groove of the finishing abrasive wheel and a plane orthogonal to the rotary shaft 4 is set to 10 to 20 degrees, and an angle defined between at least the guide slot 10 of the cover member 8 and a plane orthogonal to the rotary shaft s set to 12 to 18 degrees. Accordingly, it becomes possible to newly form the most suitable edge in the ceramic cutlery in a comparatively short time, which had worn down portions and/or chipped away portions.

7 Claims, 4 Drawing Sheets

ELECTRICALLY DRIVEN GRINDER FOR CERAMIC CUTLERY

BACKGROUND OF THE INVENTION

1. Field of the Invention

The present invention relates to an electrically driven grinder for ceramic cutlery adapted to sharpen an edge of the ceramic cutlery by bringing the edge thereof orderly into sliding contact with a diamond abrasive wheel for rough machining and a diamond abrasive wheel for finishing machining which are rotated at a high speed.

2. Prior Art

Recently, since cutlery has been required to have good abrasion resistance, chemical and corrosion resistance, ornamentalness, generally ceramic cutlery starts to be used in most households instead of a metal cutlery. But, since the ceramic cutlery has a very hard blade provided with a specialized edge shape, the edge is apt to suffer from being wasted away and/or chipped away to loose its sharpness. Even if the edge of the cutlery looses its sharpness due to those causes, a whetstone or an abrasive wheel which has been used conveniently generally among the households up to this time for sharpening metallic cutlery is not useful for sharpening the ceramic cutlery.

When studying that reason, as disclosed in Japanese Patent Publication No. 62-181860, in order to prevent the edge breakage of the ceramic cutlery and to maintain the edge sharpness thereof, it is necessary to configure the edge of the ceramic cutlery in a two stepped manner to have a tapered thick portion and an edged sharp portion formed continuously thereto, but an edge angle of which is larger than that of the metal cutlery. In practice, the metal cutlery has its edge angle often formed at an acute angle between 2 degrees and 3 degrees depending on its use. To the contrary, the ceramic cutlery has its edge angle formed in a range of 10 degrees to 45 degrees because it is apt to chip away in comparison with the metal cutlery.

On the other hand, as shown in FIG. 5, a conventional cutlery grinder 41 for sharpening an edge of metal cutlery comprises a diamond abrasive wheel 42 rotatably arranged within a casing 48 and having a grinding surface 44 for rough machining and a grinding surface 46 for finishing machining. The diamond abrasive wheel 42 comprises a substantially disc-shaped member 47 formed by connecting two truncated cones 43, 45 to each other so as to have a substantially V-shaped groove formed in its periphery by their tapered surfaces with different inclination angles. The grinding surfaces 44, 46 are provided by securing different sizes of diamond abrasive grains onto the tapered surfaces by means of electrode position or the likes. When being sharpened, the edge of the metal cutlery is directed to the grinding surfaces 44, 46 by a guide slot 50 formed in a cover member 49 disposed to cover the casing 48 while the guide slot 50 intersecting with an axis of the diamond abrasive wheel 42. Incidentally, in this diamond abrasive wheel 42, an angle $\gamma$ defined by the rough grinding surface 44 and a plane orthogonal to the axis thereof is set to 20 to 25 degrees, and an angle $\theta$ defined by the finishing grinding surface 46 and a plane orthogonal to the axis thereof is set to 26 to 30 degrees (refer to Japanese Patent Post-Examination Publication No. 6-61686).

When sharpening the edge of the metal cutlery by this cutlery grinder 41, the edge of the metal cutlery is brought into contact with the grinding surfaces 44, 46 of the diamond abrasive wheel 42 and then moved forward and backward reciprocatively through a haft thereof held by a hand. Thereby, the diamond abrasive wheel 42 is rotated, so that the edge of the metal cutlery slides relatively on the grinding surfaces 44, 46 to be sharpened.

In this cutlery grinder 41, however, since the diamond abrasive wheel 42 is rotated by its sliding resistance relative to the cutlery, its rotational speed is slow. Therefore, even though this cutlery grinder 41 is used for sharpening hard ceramic cutlery, it is impossible to sharpen it. In addition, since this grinder 41 is inherently designed for the metal cutlery, inclination angles of the grinding surfaces 44, 46 formed in the diamond abrasive wheel 42 are too large to obtain an adequate edge angle required for the ceramic cutlery.

Accordingly, when sharpening the ceramic cutlery, since the cutlery must be sent back to its manufacturer for edging it. Thus, there is such a problem that a user can not utilize the cutlery all the while and further the edge sharpening costs the user. Further more, when a ceramic knife 60 is sharpened in its manufacturer, as shown in FIG. 6, an expert must hold a haft 62 of the ceramic knife 60 and press an edge 61 onto a revolving grinding surface 52 of the diamond abrasive wheel 51 so as to obtain the adequate edge angle required for the ceramic knife 60 with skillfulness. Therefore, it is impossible for ordinary people to sharpen the ceramic cutlery in that way.

SUMMARY OF THE INVENTION

It is an object of the present invention to provide an electrically driven grinder for ceramic cutlery which is capable of sharpening an edge of ceramic cutlery readily at a predetermined edge angle by an ordinary people except an expert.

The present invention is directed to solving the aforementioned problem and resides in an electrically driven grinder for ceramic cutlery, having: a diamond abrasive wheel for rough machining comprising a disc-shaped member provided with a grinding surface on its periphery;: a diamond abrasive wheel for finishing machining comprising a substantially disc-shaped member provided with grinding, surfaces forming a V-shaped groove on its periphery, both diamond abrasive wheels being attached onto a rotary shaft coupled to a driving source; and a cover member provided with guide slots for directing an edge of ceramic cutlery to the grinding surfaces of the respective diamond abrasive wheels, an angle defined between the grinding surfaces forming the V-shaped groove of the diamond abrasive wheel for finishing machining and a plane orthogonal to the rotary shaft being set to 10 to 20 degrees, and an angle defined between the guide slots of the cover member and a plane orthogonal to the rotary shaft being set to an angle of 12 to 18 degrees.

The electrically driven grinder of the present invention allows the formation of an edge having an edge angle of 35 to 45 degrees in the ceramic cutlery, therefore, obtaining high sharpness without any chipped portions by. grinding the edge of the ceramic cutlery with this grinder.

Further, in the present invention the sizes of diamond abrasive grains may be set to #600 to #1000 in grain size number on the grinding surface of the diamond abrasive wheel for finishing machining, and the sizes of diamond abrasive grains on the grinding surface of the diamond abrasive wheel for rough machining may be set to #150 to #350. Accordingly, the edge of the ceramic cutlery can be sharpened in a comparatively short time as well as a sharp cutting capability can be recovered.

BRIEF DESCRIPTION OF THE DRAWINGS

The present invention will be explained in more details with reference to the accompanying drawings, in which:

FIGS. 1A and 1B show one example of an electrically driven grinder for ceramic cutlery according to the present invention, wherein FIG. 1A is a partially sectional plan. view and FIG. 1B is a sectional front view;

FIGS. 2A and 2B show a diamond abrasive wheel for rough machining adapted to be installed to a grinder for ceramic cutlery according to the present invention, wherein FIG. 2A is a side view and FIG. 2B is a front view;

FIGS. 3A and 3B show a diamond abrasive wheel for finishing machining adapted to be installed to a grinder for ceramic cutlery according to the present invention, wherein FIG. 3A is a side view and FIG. 3B is a front view;

DESCRIPTION OF THE PREFERRED EMBODIMENTS

Now, the present invention will be explained by preferred embodiments with reference to the attached drawings hereinafter.

Figure 1A:
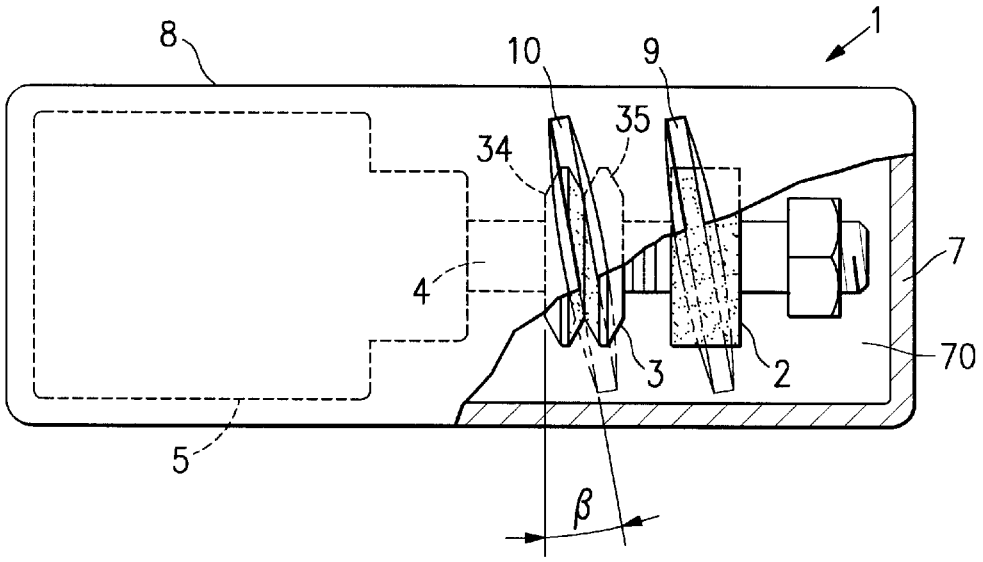
Figure 1B:
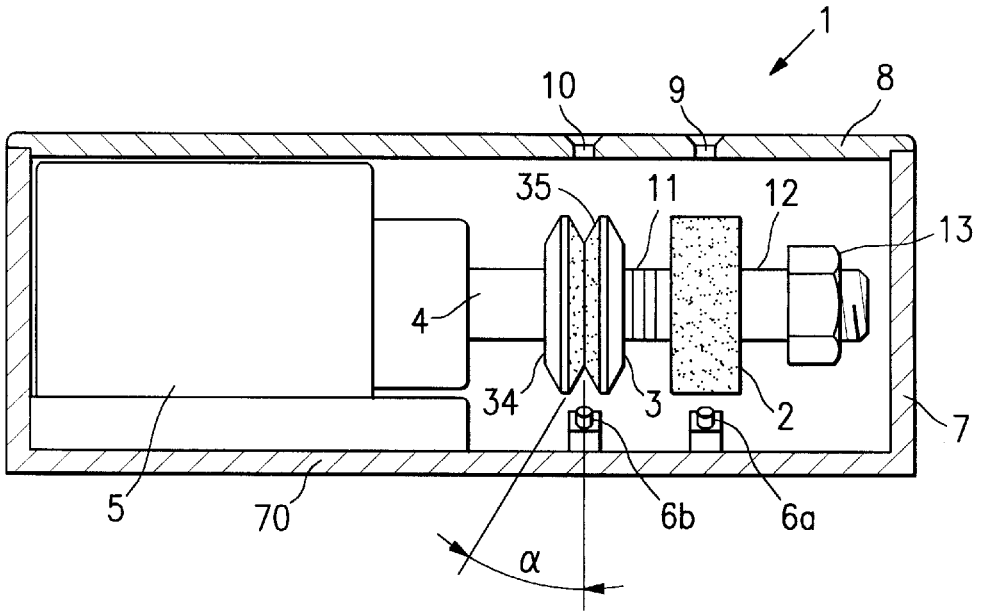

As shown in FIGS. 1A and 1B, a grinder 1 for grinding ceramic cutlery has a motor 5 as a driving source, a rotary shaft 4 coupled to the motor 5, a diamond abrasive wheel 2 for rough machining (referred to as a rough machining abrasive wheel 2 hereinafter) as well as a diamond abrasive wheel 3 for finishing machining (referred to as a finishing abrasive wheel 3 hereinafter), both of which are attached to the rotary shaft 4, and a casing 7 for receiving all of them arranged therein.

Figure 2A:
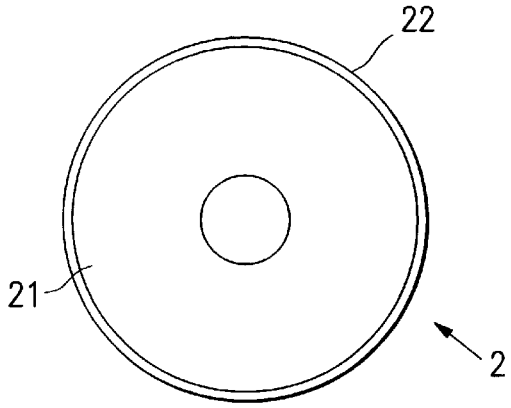
Figure 2B:
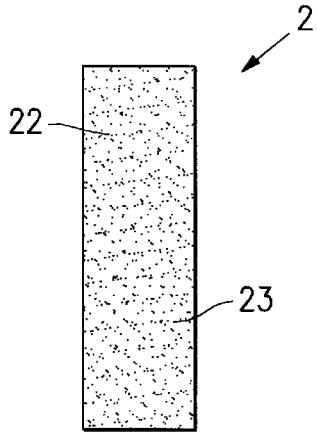
Figure 3A:
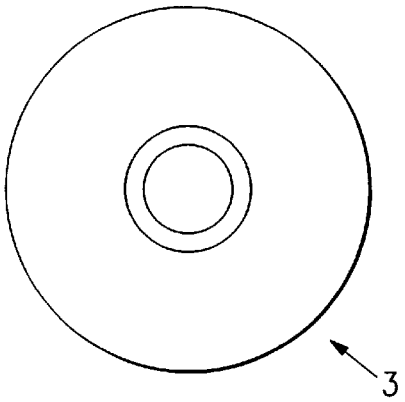
Figure 3B:
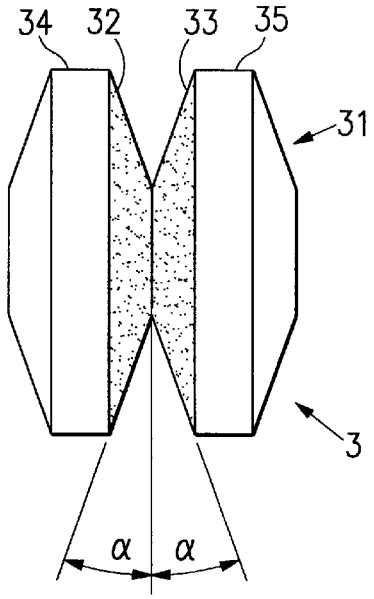

As shown in FIGS. 2A and 2B, the rough machining abrasive wheel 2 comprises a disc-shaped member 21 having a plain grinding surface 22 provided by securing rough diamond abrasive grains 23 onto its periphery by means of electrode position. Also, as shown in FIGS. 3A and 3B, the: finishing abrasive wheel 3 comprises a substantially disc-shaped member 31 formed by connecting two tapered discs 34, 35 to each other, a side of each discs 34, 35 having a tapered grinding surfaces at its peripheral edges, and the grinding surfaces face to each other to provide a V-shaped groove of grinding surfaces 32 formed by securing fine diamond abrasive grains 33 onto its peripheral tapered surfaces of the V-shaped groove by means of electrodeposition.

These abrasive wheels 2, 3 are attached to the rotary shaft 4 by firstly fitting the finishing abrasive wheel 3 to a leading end portion of the rotary shaft 4 having a slightly reduced diameter so as to come into contact with a shoulder portion of the shaft 4, then fitting the rough machining abrasive wheel 2 thereto through a plurality of spacers 11 so as to be spaced apart from the finishing abrasive wheel 3, further fitting a spacer 12 thereto, and finally, engaging a nut 13 with a threaded portion formed in the leading end portion and tightening the nut 13 for fixation. Wear and tear of the grinding surface 22 of the abrasive wheel 2 caused by the sliding contact with the ceramic cutlery is made evenly by adjusting the number of spacers 11.

The casing 7 is provided with a cover member 8 having two guide slots 9, 10 for directing an edge of ceramic cutlery to the grinding surfaces 22, 32 of the respective abrasive wheels 2, 3.

As one of main features of the present invention, an. angle β defined between the respective guide slots 9, 10 and a plane orthogonal to the rotary shaft 4 is set to 12 to 18 degrees, as well as an angle α defined between the grinding surfaces 32 forming the V-shaped groove of the finishing abrasive wheel 3 and a plane orthogonal to the rotary shaft 4 is set to 10 to 20 degrees.

Generally, the edge angle of the ceramic cutlery is formed within a range of 10 to 45 degrees. But, specifically from a point of view of preventing edge damages such as chipping away or the likes, the edge angle of the ceramic cutlery is preferably formed within a range of 35 to 45 degrees as another main feature of the present invention. There is an important correlation between the angles α, β and the edge angle within a range of 35 to 45 degrees. That is, if the angle β defined between the respective guide slots 9, 10 and the plane orthogonal to the rotary shaft 4 is out of its above-mentioned range, or if the angle α defined between the grinding surfaces 32. forming the V-shaped groove of the finishing abrasive wheel 3 and a plane orthogonal to the rotary shaft 4 is out of its above-mentioned range, it becomes impossible to form; the edge angle within the range of 35 to 45 degrees. Incidentally, in FIGS. 1A and 1B, both of the guide slots 9, 10 are formed in such an inclination angle as to have the angle β of 12 to 18 degrees with respect to the plane orthogonal to the rotary shaft 4 in a plan view, it is enough to incline at least only the guide slot 10 for the finishing abrasive wheel 3 within above mentioned range with respect to the plane orthogonal to the rotary shaft 4.

Figure 4:
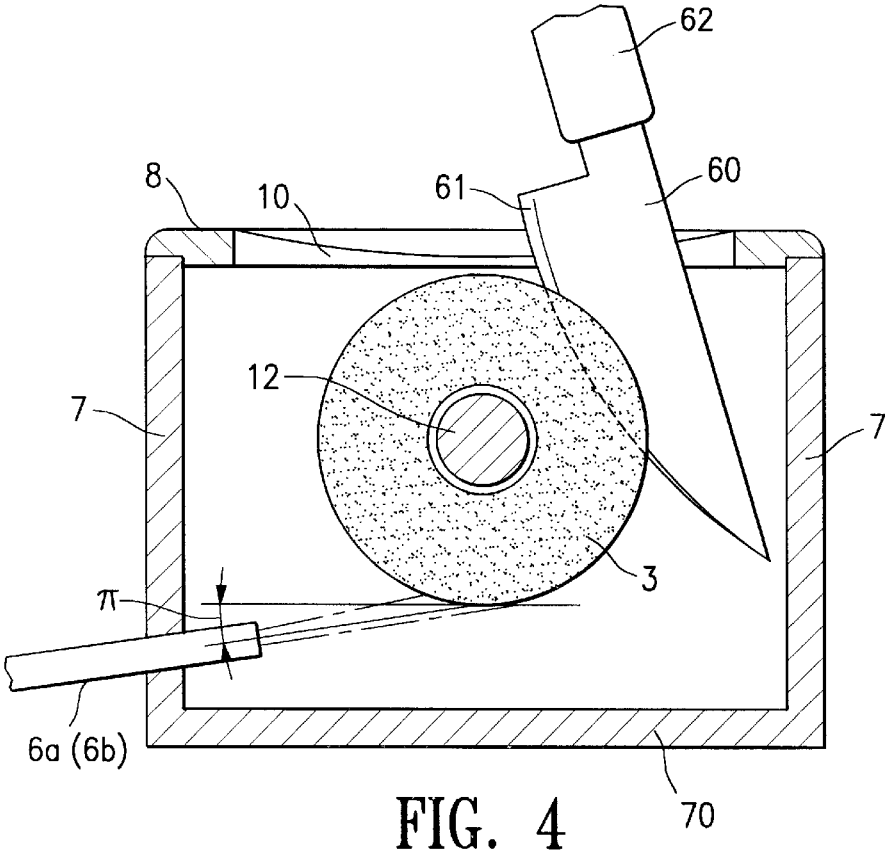
FIG. 4 is an explanatory view for explaining a disposition of a nozzle mounted onto a grinder for ceramic cutlery according to the present invention.
Figure 5:
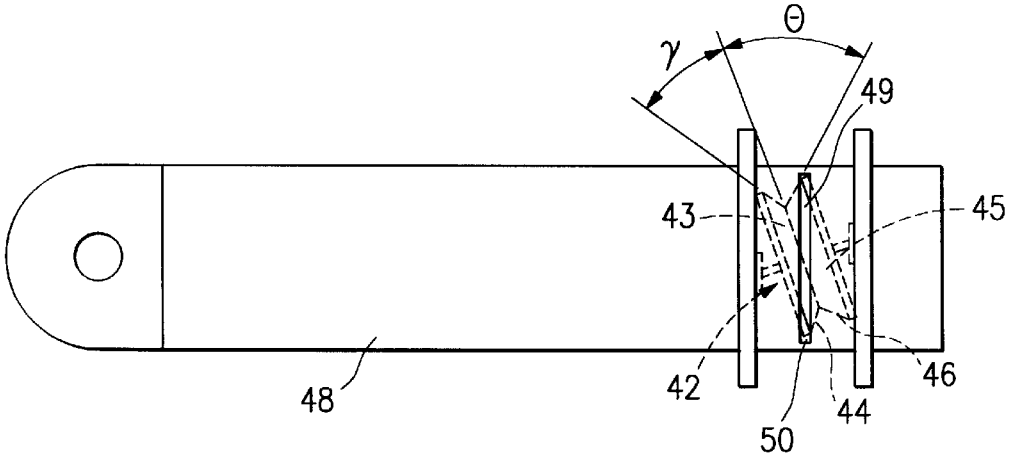
FIG. 5 PRIOR ART
FIG. 5 is a plan view showing of a conventional cutlery grinder.
Figure 6:
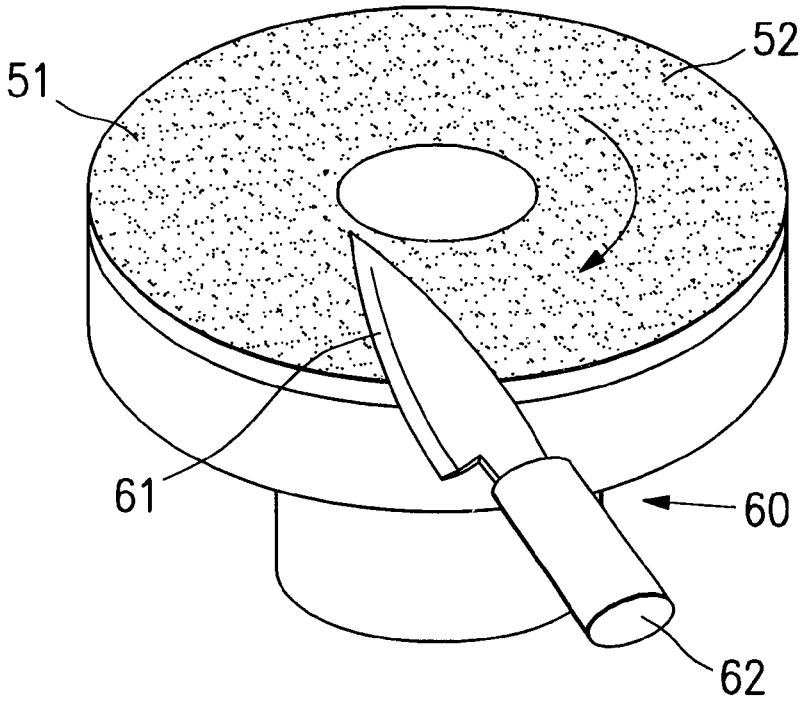
FIG. 6 PRIOR ART
FIG. 6 is an explanatory view for explaining a conventional way for sharpening ceramic cutlery.

As shown in FIG. 4, nozzles 6*a*, 6*b* for ejecting cooling water are,disposed at a bottom portion of the casing 7, so that the cooling water serves to cool the abrasive wheels 2, 3, respectively, running hot due to their sliding relative to the ceramic cutlery. It is preferable that the nozzle 6*a*, 6*b* are inclined at an angle π of 5 to 10 degrees with respect to the tangents of the respective abrasive wheels 2, 3 to eject the cooling waters.

If the setting angle n of each nozzle 6*a*, 6*b* is less than 5 degrees with respect to the tangent of each abrasive wheel 2, 3, an effective amount of the cooling water impinging against each abrasive wheel 2, 3 gets less to decrease the cooling effect. To the contrary, if the setting angle π of each nozzle 6*a*, 6*b* is more than 10 degrees with respect to the tangent of each abrasive wheel 2, 3, the cooling water is apt to come out of the guide slot 9, 10 opening above the abrasive wheel 2, 3.

Next, a way for using this grinder 1 for the ceramic cutlery will be explained hereinafter.

First of all, the respective nozzles 6*a*, 6*b* of the grinder 1 for the ceramic cutlery are connected to a cooling water supply means (not illustrated).

Next, the rough machining abrasive wheel 2 and the finishing abrasive wheel 3 are made to revolve at a speed of 6,000 rpms to 13,000 rpms by driving the motor 5, as well as the cooling waters are made to eject from the nozzles 6*a*, 6*b* toward the respective abrasive wheels 2, 3 as mentioned above.

Then, the edge partially chipped away of the ceramic cutlery is put into the guide slot 9 so as to come into contact with the grinding surface 22 of the rough machining abrasive wheel 2 to remove the chipped away portion of the edge, and subsequently the edge is put into the guide slot 10 so as to come into contact with the V-shaped groove shaped grinding surfaces 32 of the finishing abrasive wheel 3. Thereupon, one side of the ceramic cutlery comes into contact with one tapered grinding surface 32 as well as the other side of the ceramic cutlery comes into contact with the other tapered grinding surface 32. Since the angle β defined between the guide slot 10 and the plane orthogonal to the rotary shaft 4 is set to 12 to 18 degrees as well as the angle α defined between the grinding surfaces 32 forming the V-shaped groove of the finishing abrasive wheel 3 and the plane orthogonal to the rotary shaft 4 is set to 10 to 20 degrees, consequently the ceramic cutlery is sharpened so that its edge angle can have a sharp two stepped edge within the range of 35 degrees to 45 degrees.

By the way, as diamond abrasive grains 23 on the grinding surface 22 of the rough machining abrasive wheel 2 can be used the one having a grain size of #150 to #350, and as diamond abrasive grains 33 on the grinding surface 32 of the finishing abrasive wheel 3 can be used the one. having a grain size of #600 to #1000.

Here, the grain size numbers of diamond in this description are defined with accordance to JIS R6001 (Abrasive Grain Size).

If the grain size of the diamond abrasive grains 23 provided on the rough machining grinding surface 22 is less than #150, it is too rough for the ceramic cutlery to be sharpened well, remaining small chipped away portions caused the rough diamond abrasive grains 23. To the contrary, if the grain size number thereof is more than #350, its grinding capability lowers, so that disadvantageously it takes much time to remove chipped away portions completely. Further, if the grain size of the diamond abrasive grains 33 provided on the finishing machining grinding surface 32 is less than #600, it is possible to remove viewable chipped away portions, but disadvantageously it is impossible to obtain a good sharpness. To the contrary, if the grain size thereof is more than #1000, its grinding capability lowers, so that disadvantageously it takes too much time to obtain the sharp edge of the ceramic cutlery.

Incidentally, the present invention is not limited to these practical modes, but of course, any improvements and/or modifications of design may be made without departing a scope of the present invention.

Embodiment 1.

An experiment was conducted to confirm finished edge angles of newly edged ceramic cutlery having their chipped away portions removed by the grinder 1 for the ceramic cutlery as shown in FIGS. 1A and 1B under such a condition that the angle α defined between the guide slot 10 and the plane orthogonal to the rotary shaft 4 and the angle a defined between the grinding surfaces 32 forming the V-shaped groove of the finishing abrasive wheel 3 and the plane orthogonal to the rotary shaft 4 are set to different degrees to each other.

As further conditions of this experiment, the grain size of the diamond abrasive grains 23 provided on the grinding surface 22 of the rough machining abrasive wheel 2 is set to #170. On the other hand, the grain size of the diamond abrasive grains 33 for the finishing abrasive wheel 3 is set to #800. The rotational speed of the respective abrasive wheels 2, 3 is set to 10,000 rpm. The results of experiment are as shown in Table 1.

TABLE 1

| Specimen No. | Angle α(°) defined between finishing grinding surfaces and plane orthogonal to the rotary shaft | Angle (°) defined between diamond abrasive wheel and guide slot | Edge angle (°) after sharpening |
|---|---|---|---|
| *1 | 5 | 12 | 25 |
| *2 | 5 | 18 | 32 |
| *3 | 10 | 10 | 28 |
| 4 | 10 | 18 | 37 |
| 5 | 15 | 12 | 39 |
| 6 | 15 | 15 | 40 |
| 7 | 20 | 18 | 43 |
| 8 | 20 | 12 | 41 |
| *9 | 20 | 10 | 46 |
| *10 | 25 | 10 | 48 |

*Without a scope of the present invention

When studying those experimental results, it can be confirmed that when the angle α defined between the guide slot 10 and the plane orthogonal to the rotary shaft 4 is set to 10 degrees to 20 degrees as well as the a defined between the grinding surfaces 32 forming the V-shaped groove of the finishing abrasive wheel 3 and the plane orthogonal to the rotary shaft 4 is set to 10 degrees to 20 degrees, it becomes possible to form the edge angle of the ceramic cutlery within a range of 35 degrees to 45 degrees.

Embodiment 2.

We had an experiment of the confirming the sharpness and the time required for grinding obtained when the grain size of the diamond abrasive grains 23 provided on the grinding surface 22 of the rough machining abrasive wheel 2 and the grain size of the diamond abrasive grains 33 provided on the grinding surface 32 of the finishing abrasive wheel 3 are set to several different values in the grinder 1 for the ceramic cutlery having the angle β defined between the guide slot 10 and the plane orthogonal to the rotary shaft 4 set to 15 degrees and the angle α defined between the grinding surfaces 32 forming the V-shaped groove of the finishing abrasive wheel 3 and the plane orthogonal to the rotary shaft 4 set to 15 degrees as shown in Specimen No. 6 in Table 1.

Incidentally, in this experiment such ceramic cutleries having the chipped away portions of 0.5 mm to 0.7 mm are. employed as a specimen cutlery to be newly edged, and the sharpness is evaluated good when fully ripen tomato can be smoothly cut by its own weight without any resistance and when the time required for finishing the edge angle within the range of 35 degrees to 45 degrees is at most 5 mins. But, when evaluating the sharpness, the tomato is to be cut after the paper (PPC: regenerated paper having a thickness of 0.08 mm) is cut at least 100 meter's distance by a specimen cutlery under such a condition of a load of 50 gf being previously applied to the ceramic cutlery.

Experimental results are as shown in Table 2.

TABLE 2

| Specimen No. | Grain size (#) of diamond abrasive grains provided on grinding surface of rough machining | Grain size (#) of diamond abrasive grains provided on grinding surface of finishing machining | Time required for grinding | Sharpness |
|---|---|---|---|---|
| *11 | 100 | 450 | | |
| 12 | 170 | 600 | 1 min 30 s | good |
| 13 | 170 | 800 | 1 min 38 s | good |
| 14 | 230 | 600 | 1 min 15 s | good |
| 15 | 230 | 800 | 1 min 57 s | good |
| 16 | 280 | 600 | 1 min 48 s | good |
| 17 | 280 | 800 | 2 min 25 s | good |
| 18 | 350 | 1000 | 3 min 6 s | good |
| *19 | 450 | 1200 | 7 min 54 s | good |

*Without a scope of the present invention

When studying those experimental results, it can be confirmed that when the grain size of the diamond abrasive grains 23 provided on the grinding surface 22 of rough machining abrasive wheel 2 is set to less than #15 as well as the grain size of the diamond abrasive grains 33 provided on the grinding surface 32 of the finishing abrasive wheel 3 is set to less than #600 as shown in Specimen No. 11 in Table 2, since very small chipped-away portions remaining at the edge due to the large grain size of the rough machining diamond abrasive grains 23 are hardly removed completely, Specimens Nos. 12 to 18 are evaluated good.

Further, it can be confirmed that when the grain size of the diamond abrasive grains 23 provided on the grinding surface 22 of rough machining abrasive wheel 2 is set to more than #350 as well as the grain size of the diamond abrasive grains 33 provided on the grinding surface 32 of the finishing abrasive wheel 3 is set to more than #1000 as shown in Specimen No. 19 in Table 2, since it takes much time for edging the ceramic cutlery due to the lowering of grinding capability, specimen Nos. 12 to 18 are evaluated good.

Accordingly, it can be understood that when the grain size of the diamond abrasive grains 23 provided on the grinding surface 22 of rough machining abrasive wheel 2 is set to #150 to #350 as well as the grain size of the diamond abrasive grains 33 provided on the grinding surface 32 of the finishing abrasive wheel 3 is set to #600 to #1000 as shown in specimens Nos. 12 to 18 in Table 2, those specimens enable the edging within 5 mins and can be evaluated good in sharpness.

What is claimed is:

1. A grinder for sharpening a ceramic cutting blade, comprising:

a first, relatively rough, abrasive wheel having a grinding surface that is generally cylindrical; wherein the first abrasive wheel is configured for rotation about a rotational axis;

a second, relatively fine, abrasive wheel having at least two grinding surfaces configured to form a V-shaped groove; the second abrasive wheel configured for rotation about the rotational axis; and structure defining an elongated slot having a length direction;

wherein the slot is configured to guide the ceramic cutting blade into contact with the two grinding surfaces of the second abrasive wheel; and wherein the length direction of the slot is at a non-perpendicular angle to the rotational axis of the abrasive wheels.

2. The grinder of claim 1, wherein the angle between the length direction of the slot and the rotational axis of the second abrasive wheel is between twelve and eighteen degrees, and wherein angles defined by each of the two grinding surfaces of the second abrasive wheel and a plane perpendicular to the rotational axis of the wheel are both between ten and twenty degrees.

3. The grinder of claim 1, wherein the grinding surfaces of the second abrasive wheel include abrasive grains of a size between #600 and #1000.

4. The grinder of claim 3, wherein the grinding surface of the first abrasive wheel includes abrasive grains of a size between #150 and #300.

5. The grinder of claim 1, and further comprising:

a first nozzle operable to eject a cooling fluid onto the first abrasive wheel; and a second nozzle operable to eject a cooling fluid onto the second abrasive wheel;

wherein each of the first and second nozzles is inclined at an angle of between 5 and 10 degrees with respect to a tangent to the first and second abrasive wheels, respectively.

6. The grinder of claim 1, and further comprising a drive motor operable to drive the first and second abrasive wheels at a rotational velocity of between 6000 and 13,000 rpm.

7. The grinder of claim 1, further comprising structure that defines a second slot configured to guide the cutting blade into contact with the first abrasive wheel.

* * * * *